US005647180A

United States Patent [19]

Billings et al.

[11] Patent Number: 5,647,180

[45] Date of Patent: Jul. 15, 1997

[54] FIRE RESISTANT BUILDING PANEL

[75] Inventors: Patricia Billings, Leawood, Kans.; Susan Michalski, Lee's Summit, Mo.

[73] Assignee: Earth Products Limited, Leawood, Kans.

[21] Appl. No.: 523,651

[22] Filed: Sep. 5, 1995

[51] Int. Cl.[6] ..... E04B 2/30

[52] U.S. Cl. ..... 52/268; 52/348; 52/363; 52/454

[58] Field of Search ..... 52/454, 267, 268, 52/449, 344, 348, 353, 363

[56] References Cited

U.S. PATENT DOCUMENTS

| | | | |
|---|---|---|---|
| 4,253,288 | 3/1981 | Chun | 52/454 |
| 4,304,704 | 12/1981 | Billings | 523/212 |
| 4,578,915 | 4/1986 | Schneller | 52/454 X |
| 4,734,337 | 3/1988 | Patton | 428/595 |
| 5,391,245 | 2/1995 | Turner | 156/39 |

*Primary Examiner*—Carl D. Friedman
*Assistant Examiner*—Kevin D. Wilkens
*Attorney, Agent, or Firm*—Kokjer, Kircher, Bowman & Johnson

[57] ABSTRACT

A fire resistant wall or other building structure makes use of specially constructed panels secured to a metal stud framework. Each panel has a core constructed of gypsum, cement, perlite aggregate and powder, and a polyvinyl acetate catalyst. Glass fiber reinforcement is pressed into the core materials on both sides. After the panels are secured to the framework, a metal mesh lath is applied and covered with a cementious surface coating that can be smoothed and finished as desired.

3 Claims, 1 Drawing Sheet

FIRE RESISTANT BUILDING PANEL

FIELD OF THE INVENTION

This invention relates generally to building products and more particularly to a fire resistant building panel that can be used to construct load bearing walls and other structural members in various types of buildings.

BACKGROUND AND SUMMARY OF THE INVENTION

The walls, floors, ceilings, roofs and other structural components of conventionally constructed buildings offer little resistance to fire. Consequently, when a fire occurs in a building, it is able to spread quickly and pose a dangerous threat to the lives of the occupants. A particularly dangerous situation is created when load bearing walls fail structurally due to exposure to fire, because the entire building may then collapse.

The present invention is directed to a novel building panel which is fire resistant and can be used to construct load bearing walls as well as other building structures such as partitions, floors, ceilings and roofs. The invention is particularly well suited for the construction of load bearing walls because the fire resistant properties of the wall allow it to retain its structural capabilities even after having been subjected to fire for an extended period of time. The invention is further characterized by an economical manufacturing cost, the ability of the fire resistant panel to be quickly and easily incorporated into walls and other structures, and by the ability to provide a wall or ceiling surface that can be attractively finished in a conventional manner.

In accordance with the invention, a fire resistant building panel includes a core which is covered on both of its flat sides with a surface coating. The core is constructed of a composition which includes gypsum, portland cement, perlite aggregate and powder, water, and a catalyst. The surface coating on the core may be constructed of the same material as the core, with glass fibers embedded in the material to strengthen and reinforce the outside surfaces of the panel.

The fire resistant panels can be used to construct a wall or other building structure having a skeletal framework formed by metal studs. The panels can be secured to the studs through conventional screws to cover both sides of the wall surface. A paper backed metal lath is secured to both sides of the wall to cover the fire resistant panels. A finish coating is applied to the lath and may be a cementitious material consisting of gypsum, portland cement, perlite aggregate and perlite powder, water and a catalyst. The coating may be sprayed on, applied with a trowel or in some other suitable way. The cementitious finish coat is fire resistant and enhances the ability of the wall structure to resist fire.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
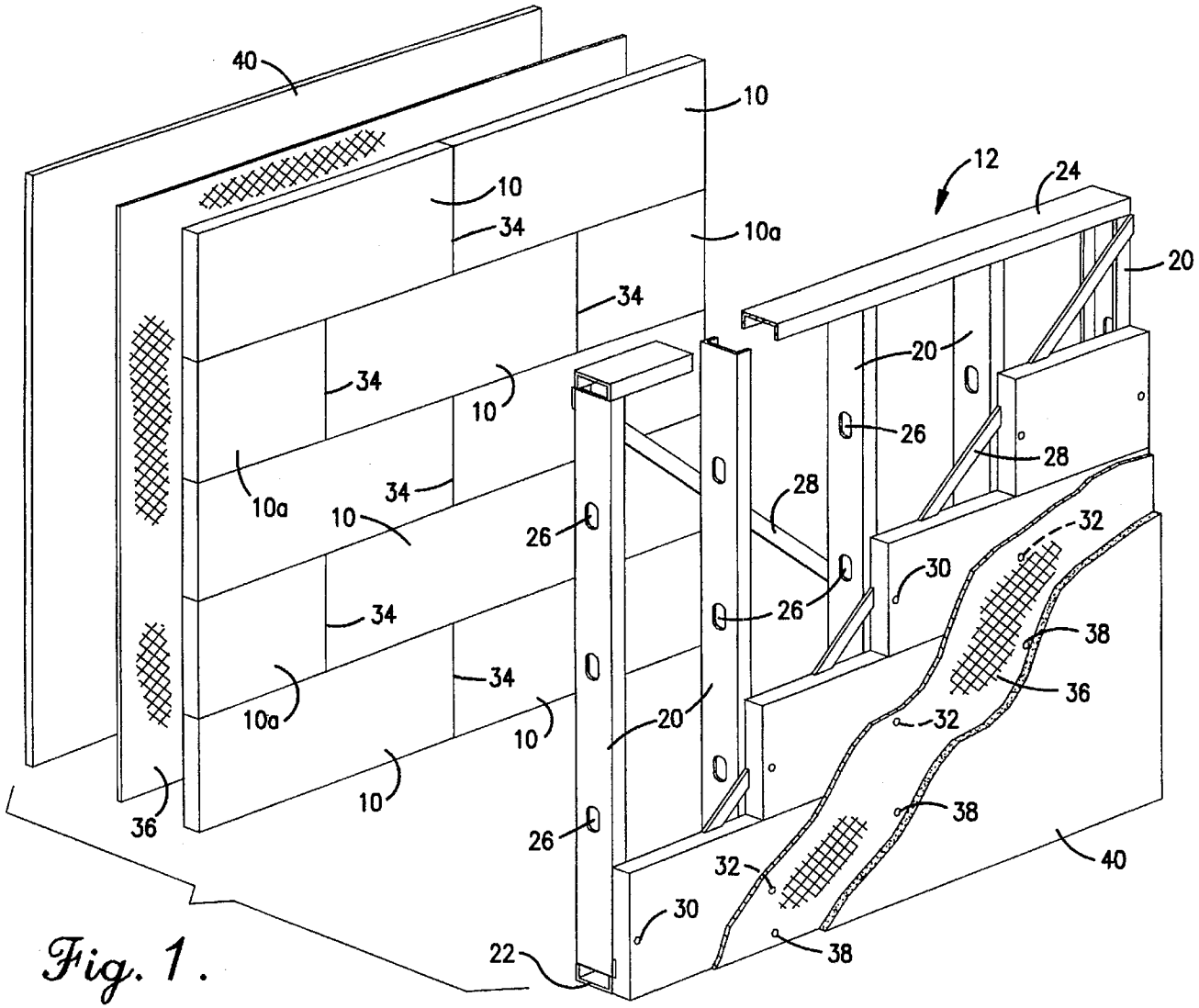
FIG. 1 is a perspective view, partially exploded, depicting a wall section constructed in accordance with a preferred embodiment of the present invention, with portions broken away for purposes of illustration.

Referring now to the drawings in more detail, the present invention is directed to specially constructed panels such as those generally identified by numeral 10 in FIG. 1 and which may be used for the construction of a building structure such as the wall identified by numeral 12 in FIG. 1. Each of the panels 10 is constructed to exhibit superior fire resistant properties.

Figure 2:
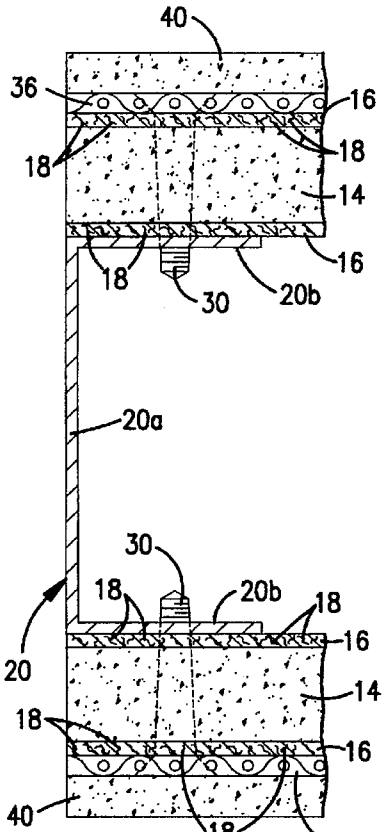
FIG. 2 is a fragmentary sectional view on an enlarged scale taken through one of the wall studs along a horizontal plan.

With particular reference to FIG. 2, each of the panels 10 includes a core 14 which takes the form of a flat panel and which is covered on its opposite flat side surfaces by a surface coating 16. The core 14 is constructed of a composition which includes gypsum, portland cement, expanded perlite aggregate, perlite powder, water, and a catalyst in the form of polyvinyl acetate. The core material is formed by mixing the liquid ingredients with the dry ingredients. The dry ingredients include the gypsum, portland cement, and the perlite aggregate and powder. The gypsum may be a high density gypsum composition which is available from U.S. Gypsum Company under the trademark HYDROSTONE. The cement may be type II portland cement. The perlite aggregate is dispersed throughout the core 14, while the perlite powder is used to fill the gaps between the perlite aggregate particles. Preferably, the dry ingredients are present in the following percentages by weight: gypsum—26.25%, portland cement—29.25%, expanded perlite aggregate—39.93%, and perlite powder—4.57%. These percentages can vary somewhat without adversely affecting the beneficial properties of the product.

The liquid ingredients of the core 14 include the polyvinyl acetate catalyst and water. A catalyst which is used to good effect is commercially available from Geobond International, Inc. as Geobond Catalyst C. The liquid portion of the core preferably includes about 9% of the catalyst and about 91% water.

The core 14 is constructed by mixing the dry ingredients together and then adding the liquid ingredients. The core 14 is molded or otherwise fabricated into the form of a flat rectangular panel. When the water evaporates, the gypsum, portland cement and perlite are bound together to provide a rigid structure for the core 14.

Each of the coatings 16 may be constructed as the same material as the core 14, with the addition of a plurality of glass fibers 18 to provide reinforcement for the outer surfaces of the panel 10. The glass fibers 18 are preferably formed by a twisted multiple strand glass fiber mesh which is embedded in the coating 16. The glass fiber mesh may be applied to the core surface, and the coating material 16 can be sprayed or otherwise suitably applied to the mesh structure.

Although the size and thickness of the panel 10 can vary, a panel thickness of about one inch has been found to be desirable in most applications. The thickness of the coatings 16 is preferably about 1/32 inch each, although again this can vary. A panel size of about four feet long and two feet wide may be employed, as this makes the panels easy to ship, store and handle during construction of the wall 12 or other building structure.

To construct the wall 12, a skeletal framework for the wall is first assembled using conventional metal wall studs 20 secured to a bottom metal channel or track 22 at their lower ends and to a top metal channel or track 24 at their upper ends. The studs 20 are parallel to one another and are spaced apart a suitable distance (a center to center distance of approximately two feet, for example). As best shown in FIG. 2, each of the studs 20 is U-shaped in section and includes a flat central web **20*a* and a pair of flanges 20*b* extending from the opposite edges of the web 20*a*. Cut outs 26 (see FIG. 1) are formed through the web 20*a* of each stud in order to accommodate wiring, pipes and other articles. The wall framework also includes flat diagonal braces 28 which are suitably secured to the flanges 20***b* of the studs 20.

The fire resistant panels 10 are secured edge to edge to the studs 20 in order to cover both sides of the wall. The panels 20 are preferably arranged with their length dimensions extending horizontally such that each of the panels 10 spans three of the studs 20 (assuming that the panel length is four feet and the studs are placed on two foot centers). Each opposite end portion of each panel 10 is secured to the wall framework by a screw 30 which is threaded into the flange 20*b* of the corresponding stud 20. A single screw 32 also attaches each panel to the intermediate stud which is aligned with the horizontal center of the panel 10. In this manner, the panels 10 are securely fastened to the studs 20 and yet a minimum number of the screws 30 and 32 is used in order to minimize the heat transfer through the wall 12.

The ends of adjacent panels 10 are butted closely together to form vertical seams 34. Each of the seams 34 is aligned with one of the studs 20, and the panel edges adjacent to each seam are each fastened with a pair of the screws 30. The seams 34 are staggered in adjacent rows of the panels in order to avoid a long continuous seam which could weaken the wall structure. Panels which are shorter than the full size panels 10 may be used to fill in spaces in at least some of the rows which are shorter than the four foot length of a full panel. For example, the panels 10*a* shown in FIG. 1 may be installed to extend from the adjacent full length panel 10 to the end of the wall where necessary. The shorter panels 10*a* may be cut to the necessary length from full sized panels.

After both sides of the wall frame work have been covered with the fire resistant panels 10 and 10*a*, a lath structure is applied to cover the outer surfaces of all of the panels 10 and 10*a*. The lath structure preferably takes the form of a paper backed steel mesh 36 which includes criss-crossing strands of steel secured to a paper backing sheet. The mesh 36 may be secured in any suitable manner such as by means of screws 38 threaded into the studs 20.

Each mesh 36 provides a substrate for a finish coating 40. The coating is a cementitious material which exhibits fire resistant properties. Each of the coatings 40 may be constructed of the same material as the core 14. However, the percentages of the constituent materials of the coating are different. Preferably, the dry portion of the coating includes by weight about 41% portland cement, about 37% HYDROSTONE gypsum, about 6.3% perlite powder and about 15.7% perlite aggregate. The coatings 40 may be sprayed onto the mesh 36, trowled on or applied in any other suitable manner. Each coating 40 may be smoothed as desired to provide a smooth finish surface for the wall 12 which can be painted, provided with wallpaper or other wall coverings, or otherwise finished in a conventional fashion.

The wall 12 can serve as either a load bearing wall or a partition wall, and the present invention also contemplates the construction of similar structures to serve as floors, ceilings, roofs and other structural components of a building.

The materials of which the wall 12 is constructed and the manner in which it is constructed provide it with superior fire resistant properties. The panels 10 and 10*a* are able to resist fire due to the materials of which they are constructed. The mesh 36 and finish coating 40 cover all of the seams 34 and the screws 30 and 32, with the finish coating 40 covering the screws 38 as well.

Testing has established the fire resistant qualities of the wall 12. The testing has included tests conducted by Underwriter's Laboratories (UL) in accordance with the standard UL 263(ASTM E119) for Fire Tests of Building Construction and Materials. This test standard involves subjecting the wall 12 to fire while also subjecting it to loads of the type it would receive when serving as a load bearing wall. A wall constructed in the manner of the wall 12 was tested and found to retain its ability to handle the loads after being subjected to fire conditions for four consecutive hours.

It is thus evident that the present invention provides unique building panels 10 which may be used in the construction of the fire resistant wall 12 or other fire resistant building structure. The building structure can be assembled quickly and easily using known techniques. It is noted that both sides of the wall 12 are covered with the fire resistant panels, the mesh 36 and the finish coating 40 and that this construction enhances the fire resistance of the wall structure.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described the invention, what is claimed is:

1. A fire resistant building panel comprising:

a core having the configuration of a flat panel and presenting opposite side surfaces, said core having a composition comprising a dry mixture mixed with water and a catalyst which includes polyvinyl acetate;

a surface coating substantially covering each of said opposite side surfaces of the core, each coating having a composition substantially identical to said core; and a glass fiber mesh embedded in each coating;

said dry mixture comprising gypsum present therein in the amount of about 26.25% by weight, cement present therein in the amount of about 29.25% by weight, expanded perlite aggregate present therein in the amount of about 40% by weight, and perlite powder present therein in the amount of about 4.5% by weight.

2. A fire resistant load bearing wall comprising:

a skeletal framework comprising a plurality of upright wall studs defining substantially planar opposite sides of said framework;

a plurality of panels each having a core presenting flat opposite surfaces and coatings substantially covering both of said surfaces, said core of each panel comprising a dry mixture mixed with water and a catalyst which includes polyvinyl acetate, said dry mixture comprising gypsum present therein in the amount of about 26.25% by weight, cement present therein in the amount of about 29.25% by weight, expanded perlite aggregate present therein in the amount of about 40% by weight, and perlite powder present therein in the amount of about 4.5% by weight, said coatings of each panel comprising a glass fiber mesh embedded in a mixture of gypsum, cement, perlite aggregate, perlite powder, water and polyvinyl acetate;

a plurality of fasteners securing said panels to said framework to cover both of said opposite sides thereof;

a paper backed metal mesh secured to and substantially covering all of the panels on both sides of the framework; and a cementitious finish layer applied to and embedding each paper backed metal mesh to provide finished wall surfaces on the wall.

3. A fire resistant load bearing wall as set forth in claim 2, wherein:

each of said panels has a length dimension and a width dimension less than the length dimension thereof;

each of said panels is oriented on said framework with the length dimension of the panel substantially perpendicular to said studs and spanning at least three studs, including two studs adjacent to opposite ends of the panel and an intermediate stud between said two studs; and said fasteners are applied in a manner utilizing one fastener connecting each panel to each of said two studs and a single fastener connecting each panel to said intermediate stud.

* * * * *